US006702509B2

(12) United States Patent
Rogers

(10) Patent No.: US 6,702,509 B2
(45) Date of Patent: Mar. 9, 2004

(54) SCAFFOLD CLAMP

(75) Inventor: Peter Rogers, Barrie (CA)

(73) Assignee: Aluma Enterprises Inc., Toronto (CA)

( * ) Notice: Subject to any disclaimer, the term of this patent is extended or adjusted under 35 U.S.C. 154(b) by 0 days.

(21) Appl. No.: 10/060,774

(22) Filed: Feb. 1, 2002

(65) Prior Publication Data

US 2002/0106237 A1 Aug. 8, 2002

(51) Int. Cl.[7] ..... F16B 7/00; F16B 7/04

(52) U.S. Cl. ..... 403/385

(58) Field of Search ..... 403/187, 188, 403/389, 192, 373, 396, 374.2, 385, 374.3, 386, 230, 286, 289, 287, 290, 398; 52/651.1; 182/186.3, 186.4, 186.7, 186.8

(56) References Cited

U.S. PATENT DOCUMENTS 914,278 A * 3/1909 Hughes ..... 403/217
1,546,082 A * 7/1925 Kempf ..... 411/355
2,194,883 A * 3/1940 Burton ..... 403/385
2,477,696 A * 8/1949 Kohnke ..... 403/385
2,853,324 A * 9/1958 Neidmann ..... 403/385
3,707,304 A * 12/1972 Gostling ..... 403/293
4,311,407 A * 1/1982 Doyle ..... 403/390
4,443,128 A * 4/1984 Yamamoto et al. ..... 403/385
4,536,102 A * 8/1985 Doyle ..... 403/390
4,566,819 A * 1/1986 Johnston ..... 403/385
4,632,221 A * 12/1986 Stanford ..... 182/186.8
4,840,513 A * 6/1989 Hackett ..... 403/49
4,846,615 A * 7/1989 Forsyth ..... 411/355

* cited by examiner

*Primary Examiner*—Robert J. Sandy
*Assistant Examiner*—Ruth C. Rodriguez

(57) ABSTRACT

The scaffold clamp of the present invention comprises a body portion, two pivotting latches attached on opposite sides of said body, two recessed sockets with each socket having a slot opening therein, and two fasteners with each fastener associated with one of said slots and passing therethrough. Each fastener includes a shank which slides through said recess with the shank having a captured wedge member on one side of the associated slot and a bolt head oversized relative to the slot and on an opposite side thereof. The fastener is captured on the body portion with the bolt head on one side of said slot and said wedge on the opposite side of said slot. The body portion includes on opposite sides thereof support recesses which cooperate with the associated latch to form a generally circular scaffold support engaging recess. The latch and wedge cooperate with the body portion to adjust the size of said circular engaging recess by movement of the wedge relative to the body portion. The body portion of the scaffold clamp is preferrably made by casting or drop forging for strength and durability.

10 Claims, 3 Drawing Sheets

SCAFFOLD CLAMP

FIELD OF THE INVENTION

The present invention relates to scaffold clamps and in particular relates to scaffold clamps with improved functionality.

BACKGROUND OF THE INVENTION

Scaffold clamps or scaffold couplers have been used for many years to structurally connect scaffold tubing in a simple manner. Many scaffold clamps comprising various components which are formed or bent to a desired shape and then welded to other formed components. These clamps include a closable latch member for closing around and releasably engaging a scaffold tube. Typically, an adjustable fastener is provided for drawing the scaffold clamp into engagement with the tube. Some scaffold clamps use a captured wedge to simplify securement of the clamp to a structure. As can be appreciated, scaffolding systems are assembled for a temporary purpose and the fast assembly as well as fast release are important characteristics for a clamp.

Many of the scaffold clamp systems available today are prone to damage and typically it is not cost effective to repair the clamp due to the design thereof. Also many scaffold systems are rented or leased and as such subject to additional abuse.

It is also desirable with respect to the scaffold clamps that the clamp be easy to use and fast to secure in different orientations. Scaffolding systems are temporary structures and therefore speed of fastening of the clamp, as well as removal of the clamp is important. In cold climates, it is important to have a clamp which does not require a lot of dexterity as the workman may be wearing gloves.

SUMMARY OF THE INVENTION

A scaffold clamp according to the present invention comprises a body portion, two pivotting latches attached on opposite sides of the body and two recess sockets, each socket having a slot opening therein. A fastener is located in each of the slot openings of a socket. Each fastener has a shank which passes through the recess and is movable within the recess and the shank has a captured wedge member on one side of the slot and a bolt head oversized relative to the slot, on the opposite side of the slot.

With this arrangement, the fastener is captured on the body portion with the bolt head on one side of the slot and the wedge on the opposite side of the slot. The body portion includes on opposite sides thereof, support recesses which cooperate with the associated latch to form a generally circular scaffold support engaging recess. The latch and wedge cooperate with the body portion to adjust the size of the circular engaging recess by movement of the wedge relative to a wedge receiving slot on the respective latch.

In a preferred embodiment, each latch includes a wedge receiving slot which acts as a guide for the wedge.

In a preferred aspect of the invention, each bolt head is positionable to be fully received within the associated recess socket of the body portion and rotatable about the axis of the shank within the recess socket.

In a further aspect of the invention, the recess sockets are located within the support recesses.

In yet a further aspect of the invention, an edge portion of each recess socket forms a peripheral edge portion of one of said support sockets.

In a further aspect of the invention, the support socket includes a series of engaging ridges extending across the support socket.

In a further aspect of the invention, each fastener is rotatable within the associated socket recess between a release position where the fastener extends away from the latch to an engaging position where the fastener passes through the latch. Each socket recess has sufficient depth to accommodate movement of the associated fastener between the release position and the engaged position while maintaining the bolt head within the confines of the socket recess.

In a different aspect of the invention, each shank includes an elongate slot recess in which the associated pivotting wedge slides. Each pivotting wedge at a narrow end thereof includes a releasable stop which blocks the wedge from passing through the elongate slot recess and a wide end which is larger than the elongate slot recess such that the wedge is captured on the fastener. With this arrangement, the wedge can be replaced by release of the stop and insertion of a new wedge which is then captured by the associated releasable stop.

In a preferred embodiment of the invention, the stop is a replaceable component fixed on said wedge.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
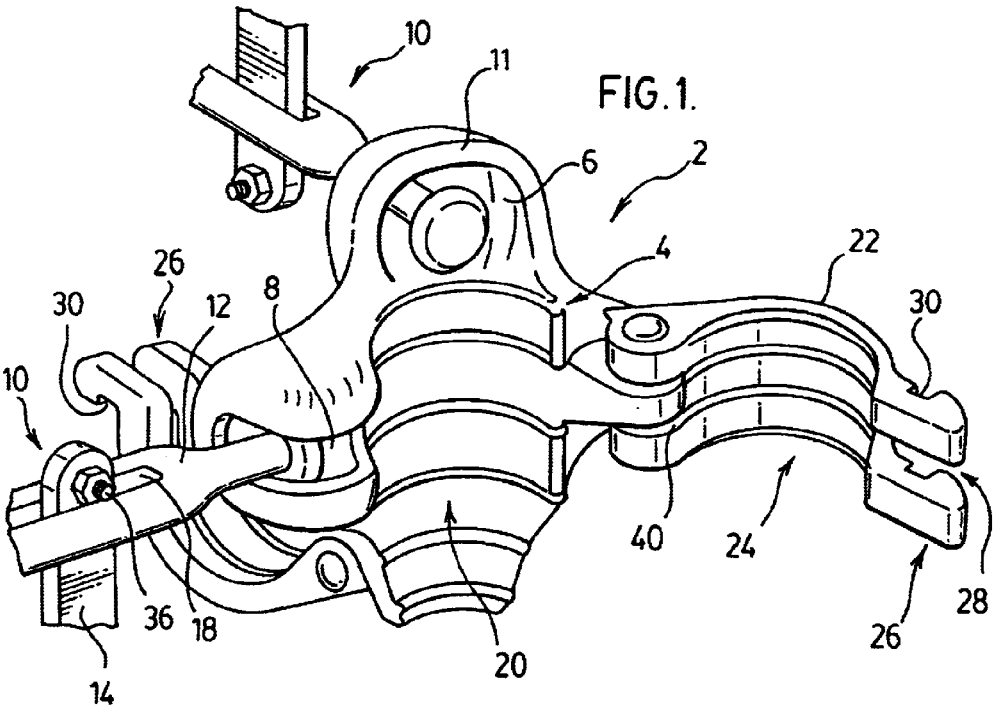
FIG. 1 is a partial perspective view of the scaffold clamp.
Figure 5:
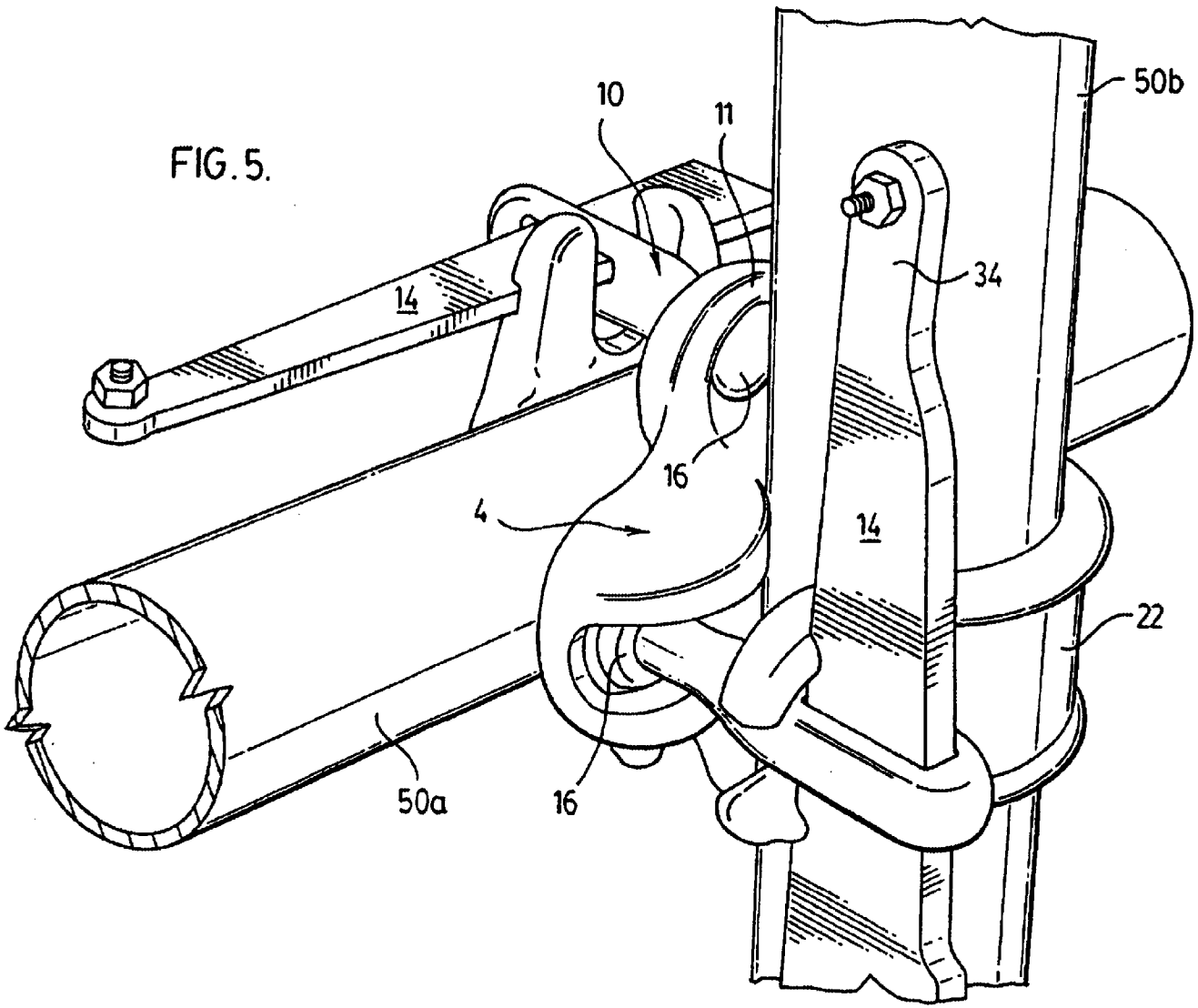
FIG. 5 is a partial perspective view of the clamp and engagement with two scaffold supports.

The scaffold clamp 2 shown in the drawings has a body 4 with recessed sockets 6 located approximately 90 degrees from one another and opening in opposite directions. Each of these recess sockets include a slot opening 8 which allows movement of the fastener 10 from a release position as shown in FIG. 1 to the engaged position as generally shown in FIG. 5. The body 4 is preferably one piece.

Figure 3:
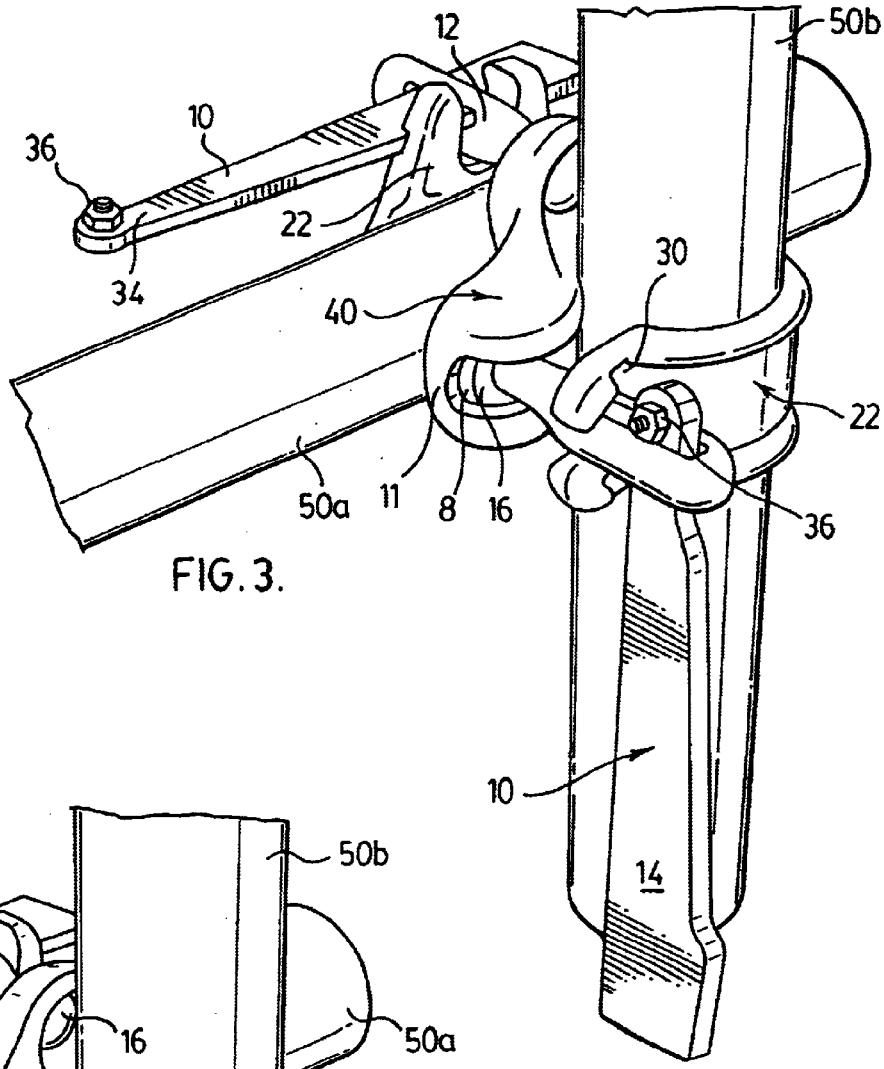
FIG. 3 is a perspective view showing the scaffold clamp engaging one scaffold support and about to engage a perpendicular scaffold support.

The fastener 10 has a bolt head 16 at one end of the shank 12 and a captured wedge 14 passing through an opposite end of the shank. The shank 12 has a closed slot 18 for receiving the generally flat captured wedge 14. The shank 12 is enlarged adjacent the slot 18 and is shaped such that it can only enter the slot 28 associated with the latch 24 in one of two orientations which orientations are 180 degrees apart. For example, the shank as shown in FIG. 1 is in one position, and if the latch 24 is brought to the closed position, the shank can be rotated and will enter into slot 28 to assume a position as shown in FIG. 3. Thus, the fastener 10 is free to rotate about the axis of the shank with the bolt head within the recess socket.

The second orientation requires the shank to be rotated about the axis of the shank 180 degrees to bring the wedge 14 to a position above the shank and then the shank is inserted into slot 28. If this rotation was to occur, the wedge as shown in FIG. 3 would actually be with the wedge positioned for downward engagement with the latch. As such the fastener 10 is reversible for engaging movement of the wedge in one of two directions 180° apart.

Figure 2:
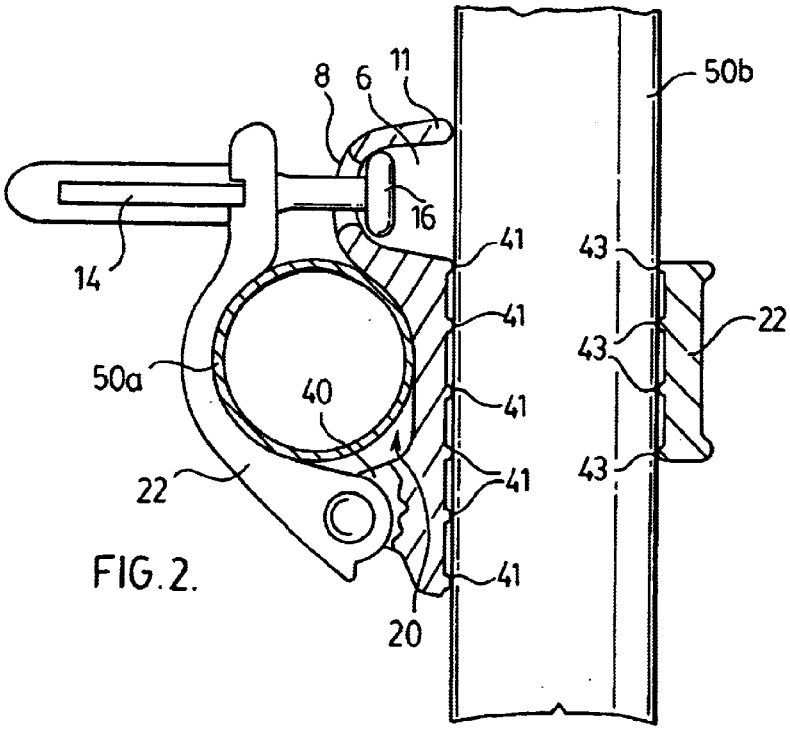
FIG. 2 is a sectional view showing the scaffold clamp engaging two scaffold supports.

The latch 22 is pivotted on the lug 40 and is moveable from a fully opened position as shown in FIG. 1 to a closed position as generally shown in FIG. 2. The captured wedge 14 is moveable from an initial position as generally shown in FIG. 3 to an engaged position by moving of the wedge upwardly such that the wedge 14 engages the receiving grooves 30 provided on the fastening flange 26. The grooves 30 serve to guide and retain the wedge on the fastening flange and avoid any possibility of the wedge sliding off the edge of the fastening flange. These grooves also locate the wedge relative to the latch and assure the wedge draws the latch into engagement with the scaffold support 50*a* or 50*b*. The wedge when appropriately driven by a hammer has an interference fit with the grooves and thus will retain the wedge in the fixed position. Thus the wedge can be driven upwardly when necessary to a locked position. Typically the fastening member is rotated such that the wedge can be driven downwardly to a fastened position.

It can be appreciated that there are certain circumstances where an upward movement of the wedge is required, often where there is a top interference condition.

The captured wedge 14 includes at a narrow end 34, a replaceable stop member 36. This is presently shown as a nut and bolt connection but it could be an enlarged rivet or other structure which forms an interference fit with the slot 18. This fastening member maintains the wedge captured on the shank 12. The opposite end of the wedge is enlarged relative to the shank slot 18 and forms the opposite restricting member. As such, the wedge is captured on the shank. Other arrangements for capturing the wedge on the shank can be used.

Figure 4:
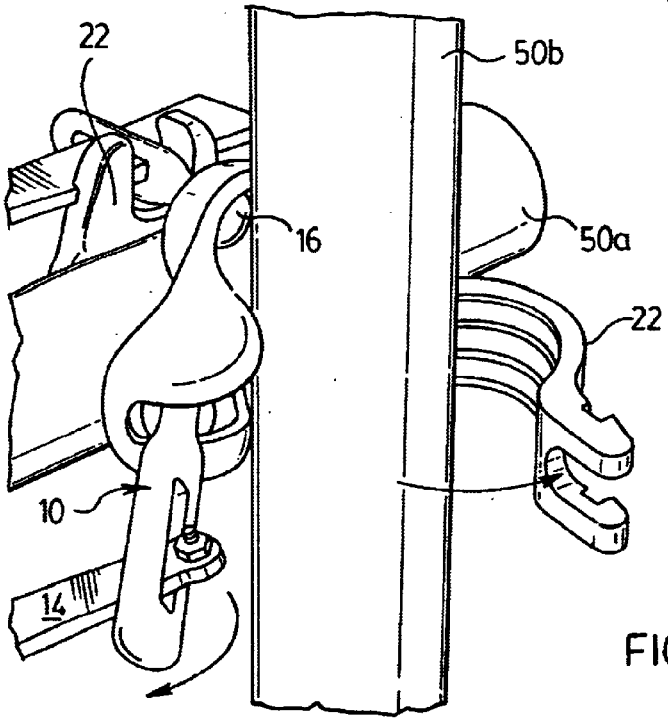
FIG. 4 is a partial perspective view showing opening of one latch and movement of the fastener to a second position for securing of the clamp.

The fastener 10 is rotatable within the recessed sockets 6. This rotation can occur essentially in any position of the fastener within the slot opening 8. For example, the fastener shown in FIG. 4 can be freely rotated about the axis of the shank to position the wedge in either an upwardly or downwardly position for engagement with the latch 22. The bolt head 16 rotates within the recessed socket 6 and is not restricted by the support 50*a* provided at the rear of the socket 6 which effectively closes the recess socket. Therefore, if the scaffold support 50*a* of FIG. 4 is initially secured, and support 50*b* is about to be secured, the user can rotate the fastener 10 to either of its two fastening positions merely by having the fastener clear the slot 28 in the latch 22 and rotate the fastener by means of rotating the wedge.

Therefore, if the worker positions support 50*a*, he still has full flexibility with respect to the securement of the support 50*b* without releasing securement of support 50*a*. This is not the case with other fasteners where the fastener 10 would have to pass out of the socket recess 6 to allow rotation thereof. With these prior art systems, the support 50*a* would have to be released, the fastener 10 then appropriately positioned and both latches then reassembled. With the present system, each latch and the fastener thereof acts independently and has full functionality independently of the other latch.

It is preferred that both the one piece body portion and the latches be formed as a single piece, for example, by casting, drop forging or pressed steel manufacture. These components when made in this manner, have excellent strength and durability and can tolerate substantial abuse. In addition, if there is damage to a latch, it can be replaced merely by removing the pivot pin and installing a new latch. If there is damage with respect to the fastener, the wedge can be removed and the fastener replaced with a new fastener using the old wedge or a new wedge. Similarly, if the wedge is damaged, it can easily be replaced by removing of the fastener 36 and installing a new wedge 14.

A further aspect of the invention is in the extended grip area of the clamp relative to the support tubes 50*a*, 50*b*. As shown in FIG. 2, the recessed socket 6 forms part of the support recess 20 and the periphery 11 of the recess socket 6 forms one end of the support recess 20. This is shown in FIG. 2 where the peripheral edge 11 forms the upper engagement with the support tube 50*b*. It can also be seen that the one piece body also extends beneath the lug 40 and thus gripping of the tube 50*b* is distributed along a substantial portion of the tube. The support recess 20 also includes a number of ribs 41 which provide positive engagement with the support tubes. Similarly, the latch 22 includes engaging ribs 43 to provide positive engagement. These ribs assist in the mechanical engagement, reduce slippage, and provide additional flexibility regarding the precise fit.

The present scaffold clamp is manufactured to provide significant strength with respect to the one piece body and the latches as well as the captured wedge. The scaffold clamp has a significantly greater useful life and is also repairable in a relatively simple manner. The typical wear components are the captured wedge 14 and the fastener 10. Each of these components, although captured on the clamp, are easily replaced. In this way, the useful life of the scaffold clamp is greatly extended. For example in a fabricated and welded clamp the life expectancy is about 4 years for rental applications whereas the life expectancy of the present clamp is much greater and in many applications will be at least 8 years.

The body portion 4 has been described in the preferred one piece construction suitable for securing scaffold supports in a perpendicular manner. It is also possible to use a two piece construction for the body which allows pivotting of the sockets to accommodate scaffold supports at different angles. In this case, the two pieces are pivotal about a pin which fastens the two pieces.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A scaffold clamp comprising a body portion, two pivotting latches attached on opposite sides of said body portion, two recessed sockets with each recess socket having a slot opening therein, and two fasteners with each fastener associated with one of said slot openings and passing therethrough, each fastener including a shank which slides through with said slot opening with said shank having a captured wedge member on one side of said associated slot opening and a bolt head oversized relative to said slot opening such that the fastener is captured on said body portion with said bolt head on one side of said slot opening and said wedge on the opposite side of said slot opening, said body portion including on opposite sides thereof support recesses which cooperate with the associated latch to form a generally circular scaffold support engaging recess, said latch and wedge cooperating with said body portion to adjust the size of said circular scaffold support engaging recess by movement of said wedge relative to said body portion; and wherein each bolt head is positionable to be fully received within the associated recessed socket of said body portion and said body portion is rotatable about the axis of the shank with said bolt head fully received in said recessed socket.

2. A scaffold clamp as claimed in claim 1 wherein each wedge cooperates with a wedge receiving slot on said respective latch which acts as a guide for said wedge and subsequently serves to retain said wedge in engagement with said respective latch.

3. A scaffold clamp as claimed in claim 1 wherein said recessed sockets are located within a depth of said support recesses.

4. A scaffold clamp as claimed in claim 1 wherein an edge portion of each recessed socket forms a peripheral edge portion of one of said support sockets.

5. A scaffold clamp as claimed in claim 4 wherein each support socket include a series of engaging ridges extending across the support socket.

6. A scaffold clamp as claimed in claim 1 wherein each fastener is rotatable within said associated recessed socket between a release position where said fastener extends away from said latch, to an engage position where said fastener passes through said latch; and wherein each recessed socket has sufficient depth to accommodate movement of said associated fastener between said release position and said engage position while maintaining said bolt head within the confines of said recessed socket.

7. A scaffold clamp as claimed in claim 6 wherein each shank includes an elongate slot recess in which said associated wedge slides, each wedge at a narrow end thereof includes a removable fastener which blocks said wedge from passing through said elongate slot recess and a wide end larger than said elongate slot recess such that said wedge is captured and replaceable by removal of said removable fastener.

8. A scaffold clamp as claimed in claim 7 wherein each wedge is generally flat.

9. A scaffold clamp as claimed in claim 1 wherein said body portion is of a one piece construction.

10. A scaffold clamp as claimed in claim 1 wherein said body portion is of at least a two piece construction where said body portion is adjustable to accommodate attachment to scaffold members at different angles.

* * * * *